US011737631B2

(12) United States Patent
Gschrey et al.

(10) Patent No.: US 11,737,631 B2
(45) Date of Patent: Aug. 29, 2023

(54) ELECTRICAL CONNECTION FOR ROBOT VACUUM LID

(71) Applicant: iRobot Corporation, Bedford, MA (US)

(72) Inventors: Travis James Gschrey, Billerica, MA (US); Eric Burbank, Lexington, MA (US); Oliver Lewis, Waltham, MA (US); Milan Modh, Waltham, MA (US); Sophia Wennstedt, Bedford, MA (US)

(73) Assignee: iRobot Corporation, Bedford, MA (US)

( * ) Notice: Subject to any disclaimer, the term of this patent is extended or adjusted under 35 U.S.C. 154(b) by 238 days.

(21) Appl. No.: 17/467,649

(22) Filed: Sep. 7, 2021

(65) Prior Publication Data

US 2022/0022714 A1 Jan. 27, 2022

Related U.S. Application Data

(62) Division of application No. 16/236,694, filed on Dec. 31, 2018, now Pat. No. 11,122,951.

(51) Int. Cl.
*A47L 11/40* (2006.01)
*A47L 9/28* (2006.01)
(Continued)

(52) U.S. Cl.
CPC ..... *A47L 11/4002* (2013.01); *A47L 9/2805* (2013.01); *A47L 9/2842* (2013.01);
(Continued)

(58) Field of Classification Search
CPC .. A47L 11/4002; A47L 9/2805; A47L 9/2842; A47L 9/2852; A47L 11/4011;
(Continued)

(56) References Cited

U.S. PATENT DOCUMENTS 10,292,554 B2 5/2019 Lewis et al.
11,122,951 B2 9/2021 Gschrey et al.
(Continued)

FOREIGN PATENT DOCUMENTS

WO WO2018/210085 * 11/2018

OTHER PUBLICATIONS

"U.S. Appl. No. 16/236,694, Restriction Requirement dated May 19, 2021", 6 pgs.
(Continued)

*Primary Examiner* — David Redding
(74) *Attorney, Agent, or Firm* — Schwegman Lundberg & Woessner, P.A.

(57) ABSTRACT

The present disclosure provides, in one aspect, method of controlling an autonomous cleaning robot, the method comprising: navigating the autonomous cleaning robot to a docking station; sensing that the autonomous cleaning robot is navigating to the docking station; increasing a vacuum power of a vacuum assembly of the autonomous cleaning robot to reduce an amount of debris from an airflow channel proximate to an inlet of a cleaning bin disposed in the autonomous cleaning robot; and then decreasing the vacuum power of the vacuum assembly of the autonomous cleaning robot.

20 Claims, 9 Drawing Sheets

(51) Int. Cl.

| | |
|---|---|
| ***H01R 13/24*** | (2006.01) |
| ***H01R 13/502*** | (2006.01) |
| ***H01R 33/74*** | (2006.01) |
| *H01R 13/03* | (2006.01) |

(52) U.S. Cl.
CPC ..... *A47L 9/2852* (2013.01); *A47L 11/4011* (2013.01); *H01R 13/2428* (2013.01); *H01R 13/2464* (2013.01); *H01R 13/502* (2013.01); *H01R 33/74* (2013.01); *A47L 2201/04* (2013.01); *A47L 2201/06* (2013.01); *H01R 13/03* (2013.01)

(58) Field of Classification Search
CPC .... A47L 2201/04; A47L 2201/06; A47L 9/00; A47L 9/1409; A47L 9/149; A47L 9/2894; A47L 2201/022; H01R 13/2428; H01R 13/2464; H01R 13/502; H01R 33/74; H01R 13/03
See application file for complete search history.

(56) References Cited

U.S. PATENT DOCUMENTS

| | | | | |
|---|---|---|---|---|
| 11,653,807 | B2 * | 5/2023 | Tang | A47L 9/2842 15/319 |
| 2019/0200826 | A1 | 7/2019 | Burbank et al. | |
| 2020/0205632 | A1 | 7/2020 | Gschrey et al. | |

OTHER PUBLICATIONS

"U.S. Appl. No. 16/236,694, Response filed Jul. 19, 2021 to Restriction Requirement dated May 19, 2021", 9 pgs.
"U.S. Appl. No. 16/236,694, Notice of Allowance dated Aug. 5, 2021", 9 pgs.
U.S. Appl. No. 16/236,694 U.S. Pat. No. 11,122,951, filed Dec. 31, 2018, Electrical Connection for Robot Vacuum Lid.

* cited by examiner

ELECTRICAL CONNECTION FOR ROBOT VACUUM LID

TECHNICAL FIELD

This specification relates to electrical connection mechanisms for robotic vacuum lids.

BACKGROUND

Cleaning robots include mobile robots that autonomously perform cleaning tasks within an environment, e.g., a home. Many kinds of cleaning robots are autonomous to some degree and in different ways. The cleaning robots can autonomously navigate about the environment and ingest debris as they autonomously navigate the environment. The ingested debris are often stored in cleaning bins that can be manually removed from the cleaning robots so that debris can be emptied from the cleaning bins. A cleaning robot can include a light ring that can provide visual indications that can represent the status of the cleaning robot.

SUMMARY

Described herein is a system and method for maintaining an electrical connection to a light ring in a lid of an autonomous cleaning robot. During operation of an autonomous cleaning robot, e.g., a vacuuming robot, if the electrical connection to the light ring is disrupted, the light ring may not illuminate. Certain events may disrupt the electrical connection, such as position changes in the lid after the autonomous cleaning robot bumps into an object, or a cleaning bin improperly seated in a cavity of the autonomous cleaning robot due to debris build up beneath the cleaning bin. When the cleaning bin is unable to seat properly in the cavity of the autonomous cleaning robot, the cleaning bin may press upward on an underside the lid of the autonomous cleaning robot and may interfere with an electrical connection between the lid of the autonomous cleaning robot and the robot body. Three aspects of the autonomous cleaning robot and its operation may advantageously reduce or eliminate this problem. First, a bottom surface that defines the cavity may include surface features to create a vertical space where debris may collect without disrupting the cleaning bin's position. Second, the autonomous cleaning robot may be operated to clear debris from an airflow channel prior to removal of the cleaning bin from the autonomous cleaning robot. Third, the electrical contact assembly is configured to maintain contact with the lid over a wide range of vertical heights, allowing the electrical connection to be maintained during movement of the robot, slight off-positioning of the cleaning bin, etc.

In one aspect, an autonomous cleaning robot includes a body, a drive operable to move the body across a floor surface, and a circuit board mounted below an upper surface of the body of the autonomous cleaning robot. The autonomous cleaning robot includes one or more electrical contacts, a base of each electrical contact being mounted on the circuit board and a contact tip of each electrical contact being configured to protrude through a corresponding opening in the upper surface, wherein each electrical contact comprises a double curved structure to allow the electrical contact to be vertically flexible. The autonomous cleaning robot includes a hinged lid comprising one or more contact pads, the one or more contact pads being configured to contact corresponding electrical contacts protruding through the upper surface as the lid is opened or closed.

In some implementations, each electrical contact includes a dome-shaped dimple on the contact tip of the electrical contact.

In some implementations, the contact tip of the electrical contact includes a first material and the base of the electrical contact includes a second material, the second material being different from the first material. In some instances, the first material includes gold and the second material includes a copper alloy.

In some implementations, the lid includes a light ring configured to be powered through the one or more electrical contacts and to provide and receive data through the one or more electrical contacts. In some instances, the one or more contacts providing power are located to the inside of the one or more contacts providing and receiving data.

In some implementations, the autonomous cleaning robot of claim 1, wherein the one or more electrical contacts are configured to have a vertical travel between 1 and 2 mm.

In some implementations, each electrical contact comprises a horizontally extending free end configured to contact an underside of the upper surface of the body of the autonomous cleaning robot.

In some implementations, each electrical contact comprises a substantially horizontal surface connected to the double curved structure, wherein the substantially horizontal surface is configured to contact an underside of the upper surface of the body of the autonomous cleaning robot.

In some implementations, the upper surface comprises a raised portion through which the one or more electrical contacts protrude.

In some implementations, the contact tips of the one or more electrical contacts are configured to scrub the contact pads of the lid as the lid is opened or closed.

In some implementations, the openings of the upper surface through which the one or more contacts protrude are proximate to a hinge of the lid.

In some implementations, the contact pads have dimensions of approximately 3 mm by 3 mm.

In some implementations, the corresponding openings in the upper surface have dimensions of approximately 2.5 mm by 2.5 mm.

In some implementations, the contacts are configured to provide at least 75 grams of force on the lid when the lid is closed.

In some implementations, the circuit board is positioned between 3.5 mm and 4.5 mm below an underside of the upper surface.

In some implementations, the double curved structure comprises a number of horizontally oriented regions connected by curved regions on alternating sides, and a pair of intersecting near-vertical regions connecting to form a tip.

In some implementations, the double curved structure forms a spring with a ribbon shaped cross section.

In another aspect, a method of controlling an autonomous cleaning robot includes navigating the autonomous cleaning robot to a docking station and sensing that the autonomous cleaning robot is navigating to the docking station. The method includes increasing a vacuum power of a vacuum assembly of the autonomous cleaning robot to reduce an amount of debris from an airflow channel proximate to an inlet of a cleaning bin disposed in the autonomous cleaning robot. The method includes decreasing the vacuum power of the vacuum assembly of the autonomous cleaning robot.

In some implementations, the autonomous cleaning robot moves to the docking station as the autonomous cleaning increases the vacuum power.

In some implementations, decreasing the vacuum power of the vacuum assembly occurs when the robot is docked at the docking station.

In some implementations, decreasing the vacuum power of the vacuum assembly occurs before docking at the docking station is completed.

In some implementations, the increased vacuum power corresponds to a motor speed between 20,000 rpm and 24,000 rpm. In some instances, the increased vacuum power is corresponds to a motor speed of approximately 22,000 rpm.

In some implementations, increasing the vacuum power occurs during a time interval. In some instances the time interval is between approximately 5 seconds and 15 seconds. In some instances, the time interval is approximately 10 seconds.

In some implementations, decreasing the vacuum power is initiated before the autonomous cleaning robot contacts the docking station.

In some implementations, decreasing the vacuum power is initiated after the autonomous cleaning robot contacts the docking station.

In another aspect, an autonomous cleaning robot includes a body, a drive operable to move the body across a floor surface, and a cleaning bin cavity defined by a bottom surface in the body of the autonomous cleaning robot, the cleaning bin cavity being configured to receive a cleaning bin. The autonomous cleaning robot includes one or more pillars positioned on the bottom surface of the cleaning bin cavity, the one or more pillars extending vertically from the bottom surface and being configured to contact a bottom surface of the cleaning bin positioned in the cleaning bin cavity. The one or more pillars create a volume between the bottom surface of the cleaning bin cavity and the bottom surface of the cleaning bin.

In some implementations, each of the one or more pillars extends vertically approximately 1 mm above the bottom surface of the cleaning bin cavity.

In some implementations, each of the one or more pillars comprises a top surface and each pillar has a tapered shape extending upward toward the top surface.

In some implementations, each of the one or more pillars is approximately cylindrically shaped.

In some implementations, the autonomous cleaning robot includes four pillars, wherein two of the four pillars are positioned proximate to a flat sidewall of the cleaning bin cavity and two of the four pillars are positioned proximate to a curved sidewall of the cleaning bin cavity. In some implementations, the one or more pillars are distributed on the bottom surface of the cleaning bin cavity to support the cleaning bin in the cavity.

In some implementations, each of the one or more pillars is positioned at least 2 mm away from an edge of the bottom surface of the cleaning bin cavity.

In another aspect, an autonomous cleaning robot includes a body, a drive operable to move the body across a floor surface, and a cleaning bin cavity defined by a bottom surface in the body of the autonomous cleaning robot, the cleaning bin cavity being configured to receive a cleaning bin. The autonomous cleaning robot includes one or more pillars positioned on the bottom surface of the cleaning bin cavity, the one or more pillars extending vertically from the bottom surface and being configured to contact a bottom surface of a cleaning bin positioned in the cleaning bin cavity, wherein the one or more pillars create a volume between the bottom surface of the cleaning bin cavity and the bottom surface of the cleaning bits. The autonomous cleaning robot includes a circuit board mounted below an upper surface of the body of the autonomous cleaning robot. The autonomous cleaning robot includes one or more electrical contacts, a base of each electrical contact being mounted on the circuit hoard and a contact tip of each electrical contact being configured to protrude through a corresponding opening in the upper surface, wherein each electrical contact comprises a double curved structure configured to allow the electrical contact to be vertically flexible. The autonomous cleaning robot includes a hinged lid comprising one or more contact pads, the one or more contact pads being configured to contact corresponding electrical contacts protruding through the upper surface as the lid is opened or closed. The hinged lid is configured to cover the upper surface and the cleaning bin when the cleaning bin is positioned in the cleaning bin cavity and the hinged lid is closed.

The details of one or more implementations of the subject matter described in this specification are set forth in the accompanying drawings and the description below. Other potential features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Described herein is a system and method for maintaining an electrical connection to a light ring in a lid of an autonomous cleaning robot. Three aspects of the autonomous cleaning robot and its operation may advantageously reduce or eliminate this problem. First, a bottom surface defining the cavity may include surface features to create a vertical space where debris may collect without disrupting the cleaning bin's position. Second, the autonomous cleaning robot may be operated to clear debris from an airflow channel prior to removal of the cleaning bin from the autonomous cleaning robot. Third, the contact assembly is configured to maintain contact with the lid over a wide range of vertical heights, allowing the electrical connection to be maintained during movement of the robot, slight off positioning of the cleaning bin, etc.

Autonomous Cleaning Robot Components

Figure 1:
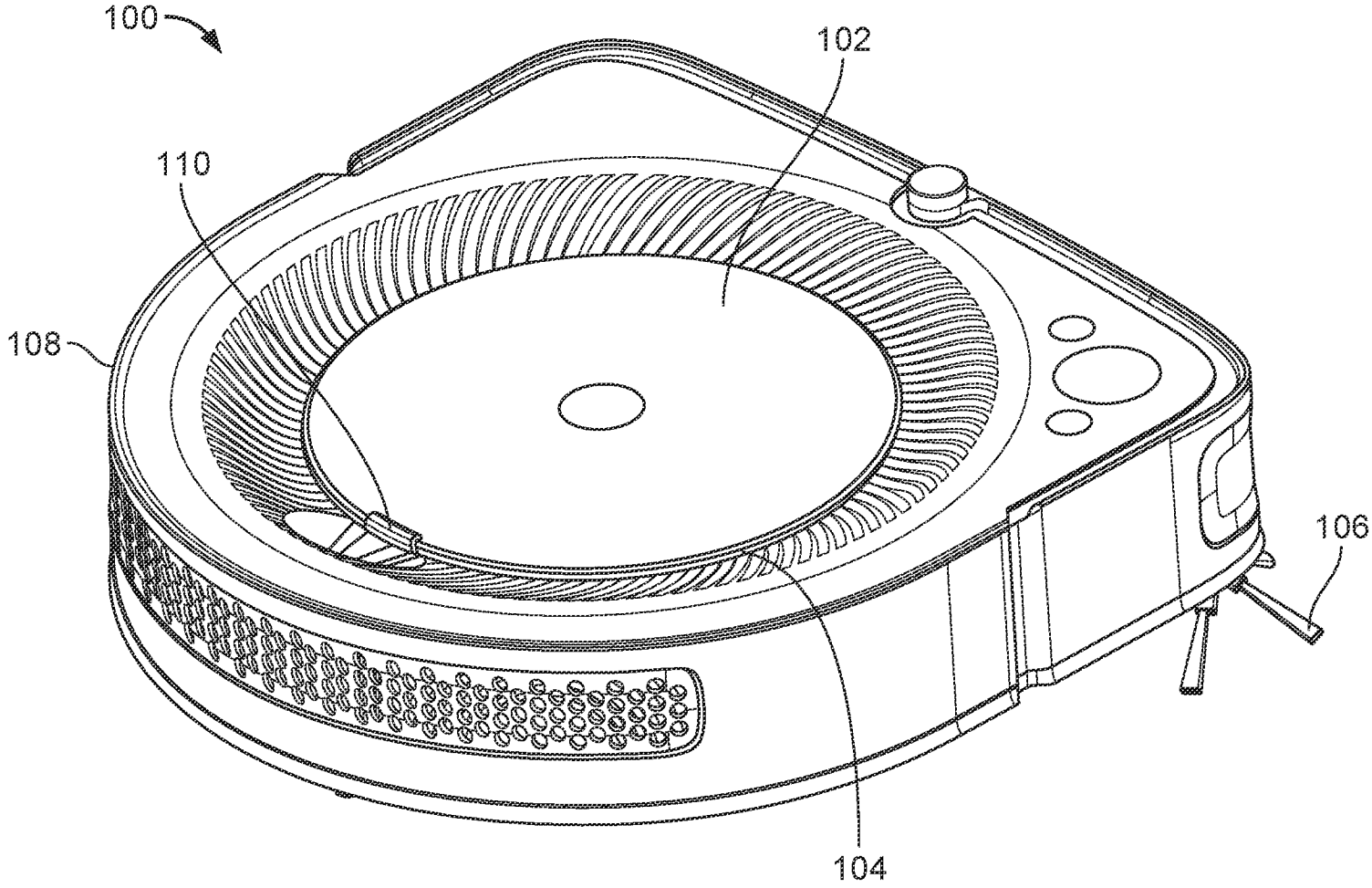
FIG. 1 is a perspective view of an autonomous cleaning robot with a lid in a closed position.

Referring to FIG. 1, an autonomous cleaning robot 100 includes a drive system (not shown) configured to propel the autonomous cleaning robot 100 along a floor surface. The autonomous cleaning robot 100 also includes a lid 102 that covers a cleaning bin 206 (shown in FIG. 2) positioned in the autonomous cleaning robot 100. The lid 102 is hingedly connected to a body 108 of the autonomous cleaning robot 100 and secures to the body 108 (e.g., by a latch 110) when the lid 102 is in the closed position. The lid 102 includes a light ring 104 configured to e.g., illuminate to indicate a status of the autonomous cleaning robot 100. A status of the autonomous cleaning robot 100 may be, for example, a status of the cleaning bin (e.g., a fullness level), a status of another component of the autonomous cleaning robot 100 (e.g., a side brush 106, a cleaning head (not shown), etc.), a status of a cleaning mission (e.g., mission complete, mission paused, mission error), etc. In some implementations, the light ring 104 is configured to illuminate in multiple different colors, in various patterns, e.g., blinking, circling, etc. To illuminate the light ring 104, an electrical connection between the lid 102 and a power source (e.g., a battery, not shown) and between the lid 102 and a controller (not shown) of the autonomous cleaning robot 100 is provided.

Figure 2:
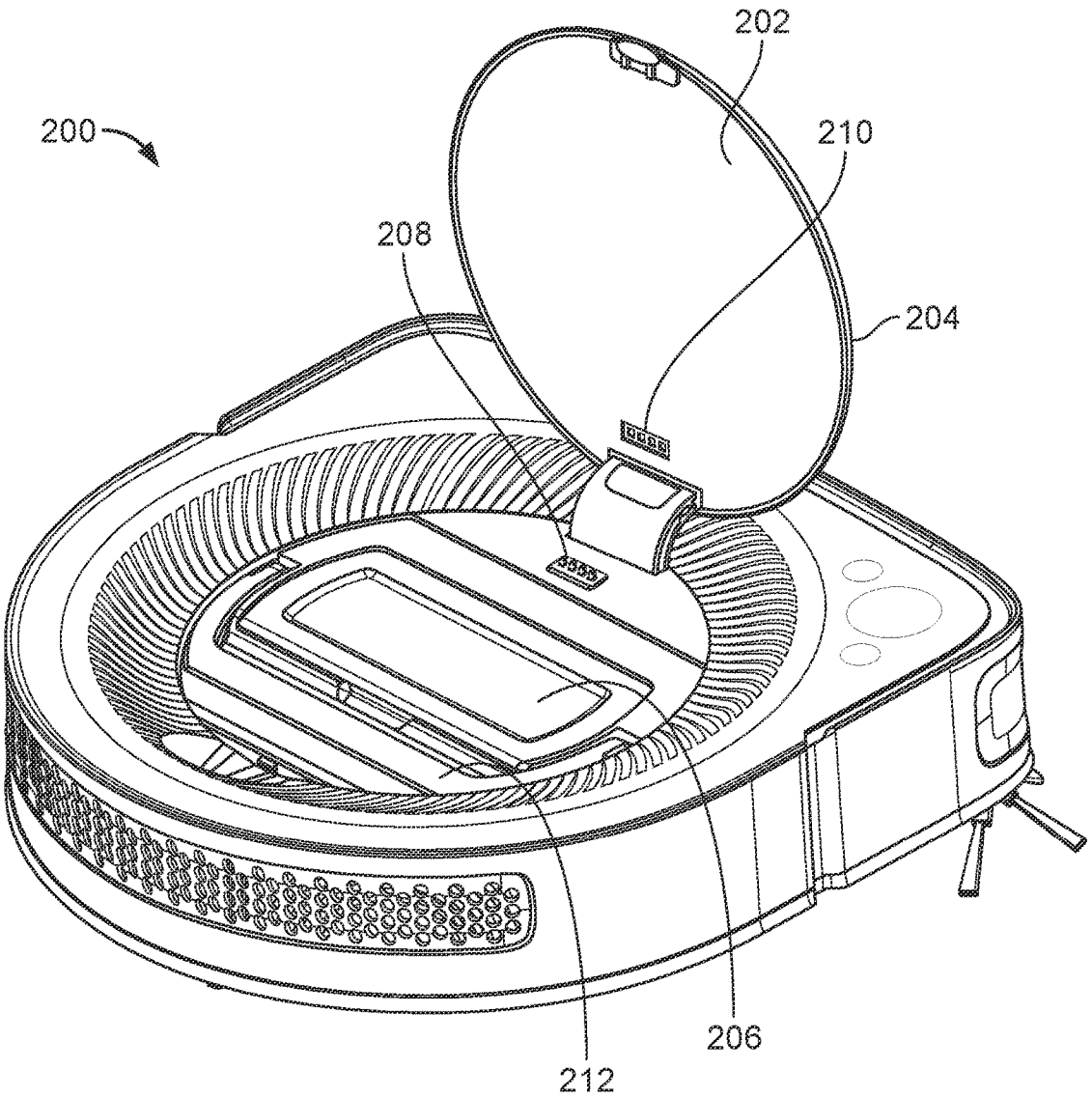
FIG. 2 is a perspective view of the autonomous cleaning robot of FIG. 1 with the lid in an open position.

Referring to FIG. 2, a lid 202 of an autonomous cleaning robot 200 is shown in an open position. In the open position, an electrical connection between the light ring 204 of the lid 202 and a contact assembly 208 of the autonomous cleaning robot 200 is broken. A connector 210 210 that electrically connects the light ring 104 and the contact assembly 208 is positioned on an underside of the lid 202 contact the contact assembly 208 when the lid 202 is in the closed position. The connector 210 includes a plurality of contact pads. A cleaning bin 206 is positioned in the autonomous cleaning robot 200 and is configured to collect debris from an airflow generated by a vacuum assembly (not shown) of the autonomous cleaning robot 200. The cleaning bin 206 includes a handle 212, which allows a user to remove the cleaning bin 206 from the autonomous cleaning robot 200 to empty the cleaning bin 206. As discussed above, in order for the lid 202 to close and for the electrical connection between the contact pads 210 and the contact assembly 208 to be formed, the cleaning bin 206 must be properly seated (e.g., positioned at a proper vertical height) in the autonomous cleaning robot 200.

Figure 3:
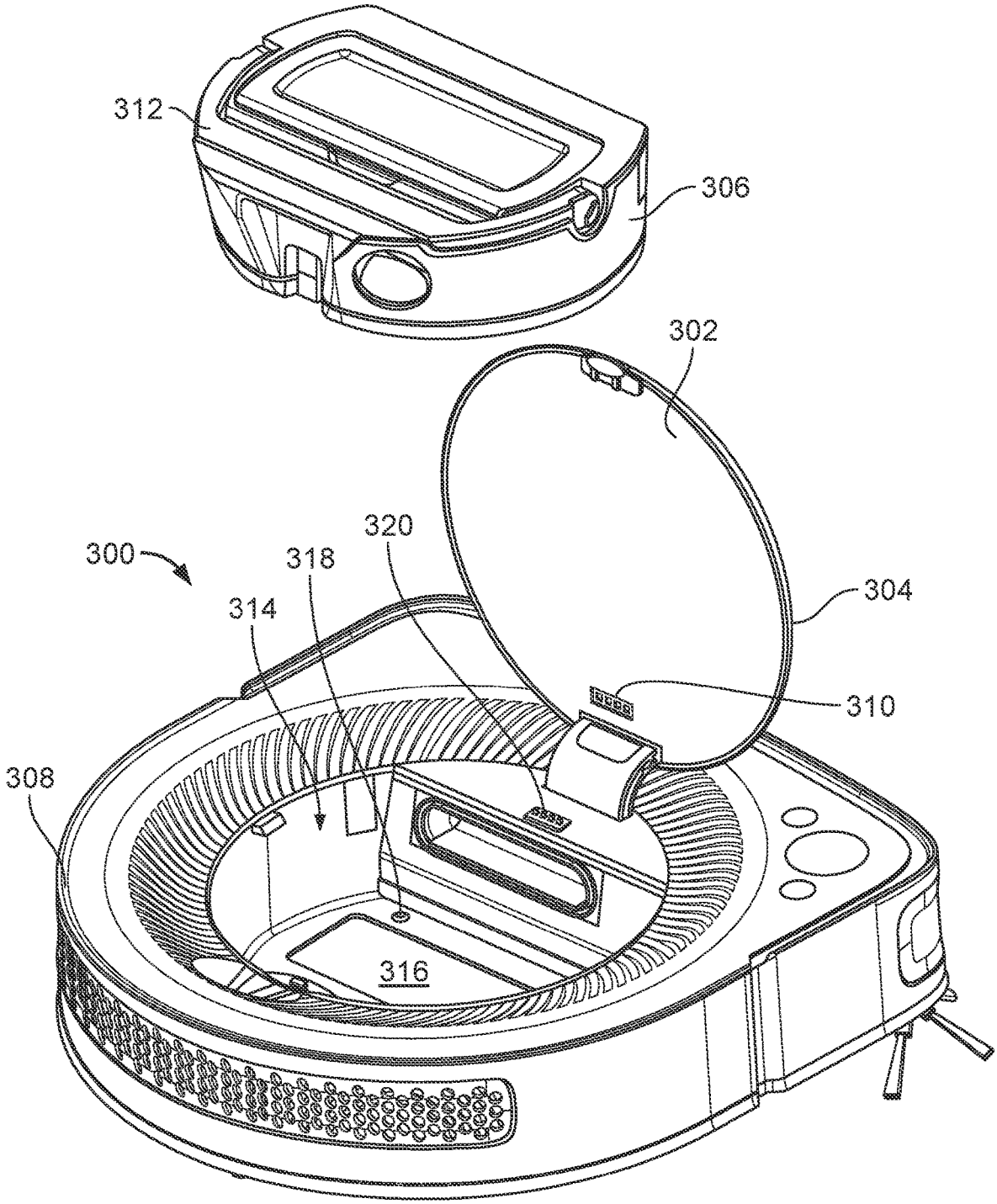
FIG. 3 is an exploded view of the autonomous cleaning robot of FIG. 1 with a cleaning bin removed.

Surface Features of a Bottom Surface of a Cavity Configured to Receive a Cleaning Bin Referring to FIG. 3, a cleaning bin 306 is illustrated as being removed from a cavity 314 of an autonomous cleaning robot 300 after a lid 302 of the autonomous cleaning robot 300 is placed in an open position. As previously described, in the open position, an electrical connection between a light ring 304 of the lid 302 and a contact assembly 320 of the autonomous cleaning robot 300 is broken. The cleaning bin 306 includes a handle 312 for easy removal of the cleaning bin 306. The cavity 314 of the autonomous cleaning robot 300 includes a bottom surface 316 configured to receive the cleaning bin 306. The bottom surface 316 defining the cavity 314 includes at least one surface feature (e.g., pillar 318) configured to position the cleaning bin 306 in the cavity 314 at a vertical position such that the electrical connection between contact pads 310 and the contact assembly 320 is formed when the lid 302 is closed. For illustrative purposes, only one pillar, pillar 318, is shown. In the present implementation, three additional pillars (not shown) are positioned, one at each corner of the bottom surface 316, similarly to the positioning of pillar 318. In some implementations, a different number of pillars may be used and the pillars may be distributed about the bottom surface 316 defining the cavity 314 in a different pattern.

Figure 4:
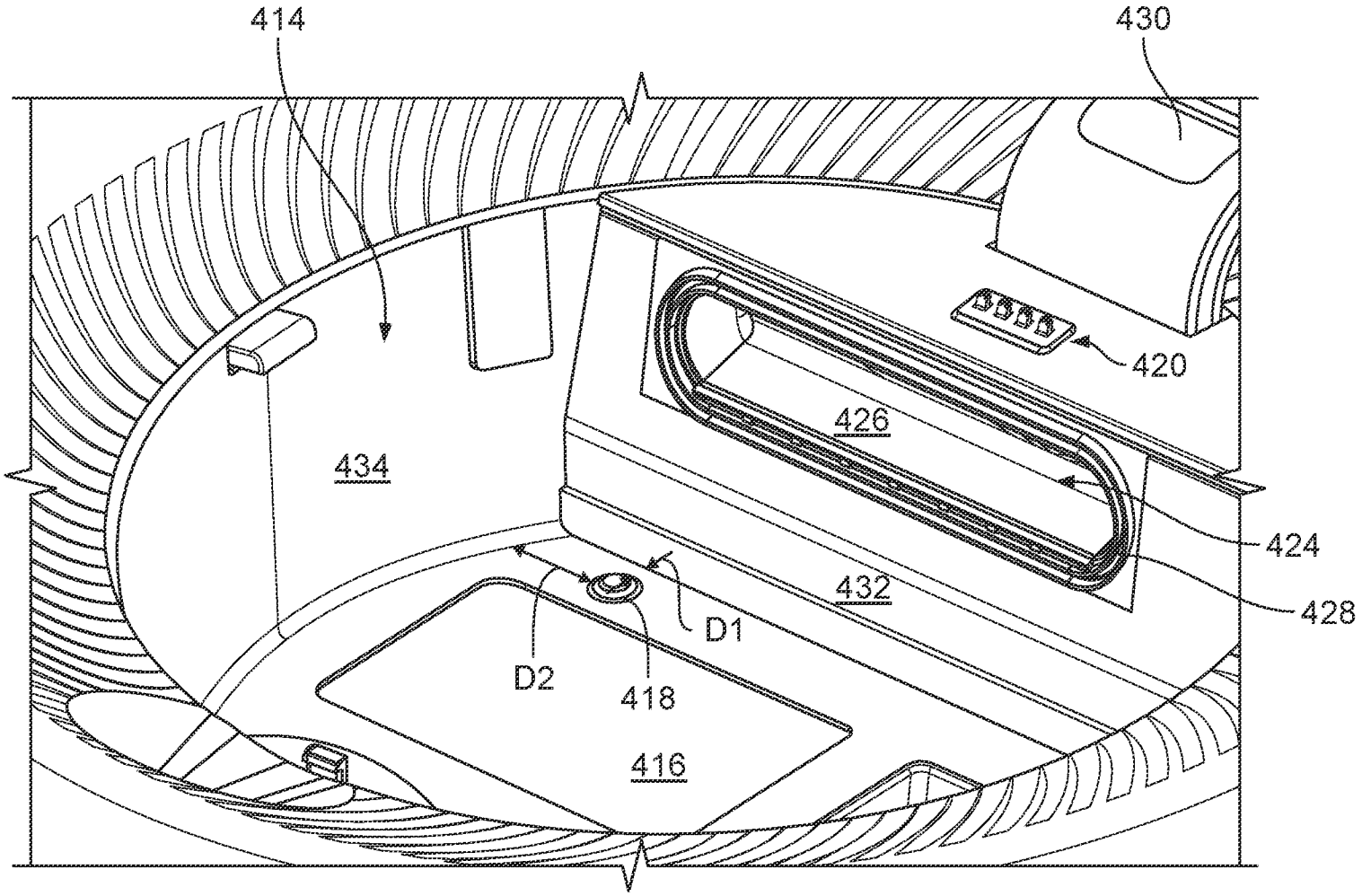
FIG. 4 is a perspective view of a cavity and vacuum inlet of the autonomous cleaning robot of FIG. 1.

Referring to FIG. 4, a cavity 414 of an autonomous cleaning robot (e.g., autonomous cleaning robot 300 shown in FIG. 3) includes a bottom surface 416 for receiving a cleaning bin (e.g., cleaning bin 306 shown in FIG. 3). When the cleaning bin 306 is positioned in the cavity 414, an inlet (not shown) of the cleaning bin 306 is positioned proximate to an outlet 424 of an airflow channel of the autonomous cleaning robot 300. The outlet 424 seals to the inlet of the cleaning bin 306 at seal 428. An airflow containing debris removed from a floor surface by the autonomous cleaning robot 300 flows through the airflow channel, through the outlet 424, and into the cleaning bin 306. Debris suspended by the airflow is deposited in the cleaning bin 306. However, debris also has a tendency to collect on a shelf 426 of the outlet 424 of the airflow channel. Debris deposited on the shelf 426 can be disturbed during removal of the cleaning bin 306 and fall onto the bottom surface 416 defining the cavity 414 of the autonomous cleaning robot 300. The outlet 424 is positioned on a first side surface 432 that defines the cavity 414 and is proximate to a hinge 430 of the lid 302 and an electrical contact assembly 420 of the autonomous cleaning robot 300.

The bottom surface 416 defining the cavity 414 includes surface features (e.g., pillar 418) to support the cleaning bin 306 when the cleaning bin 306 is positioned in the cavity 414. Various shapes, geometries, combinations of shapes may be used in forming the surface features. Pillar 418 is approximately cylindrically shaped and is positioned near a corner of the bottom surface 416 defining the cavity 414. In the present implementation, the pillar 418 is positioned approximately a distance D1 from the first side surface 432 defining the cavity 414 and approximately a distance D2 from a second side surface 434 that defines the cavity 414. In some implementations, the distance D1 may be between 2 mm and 6 mm and the distance D2 may be between 13 mm and 23 mm.

Figure 5:
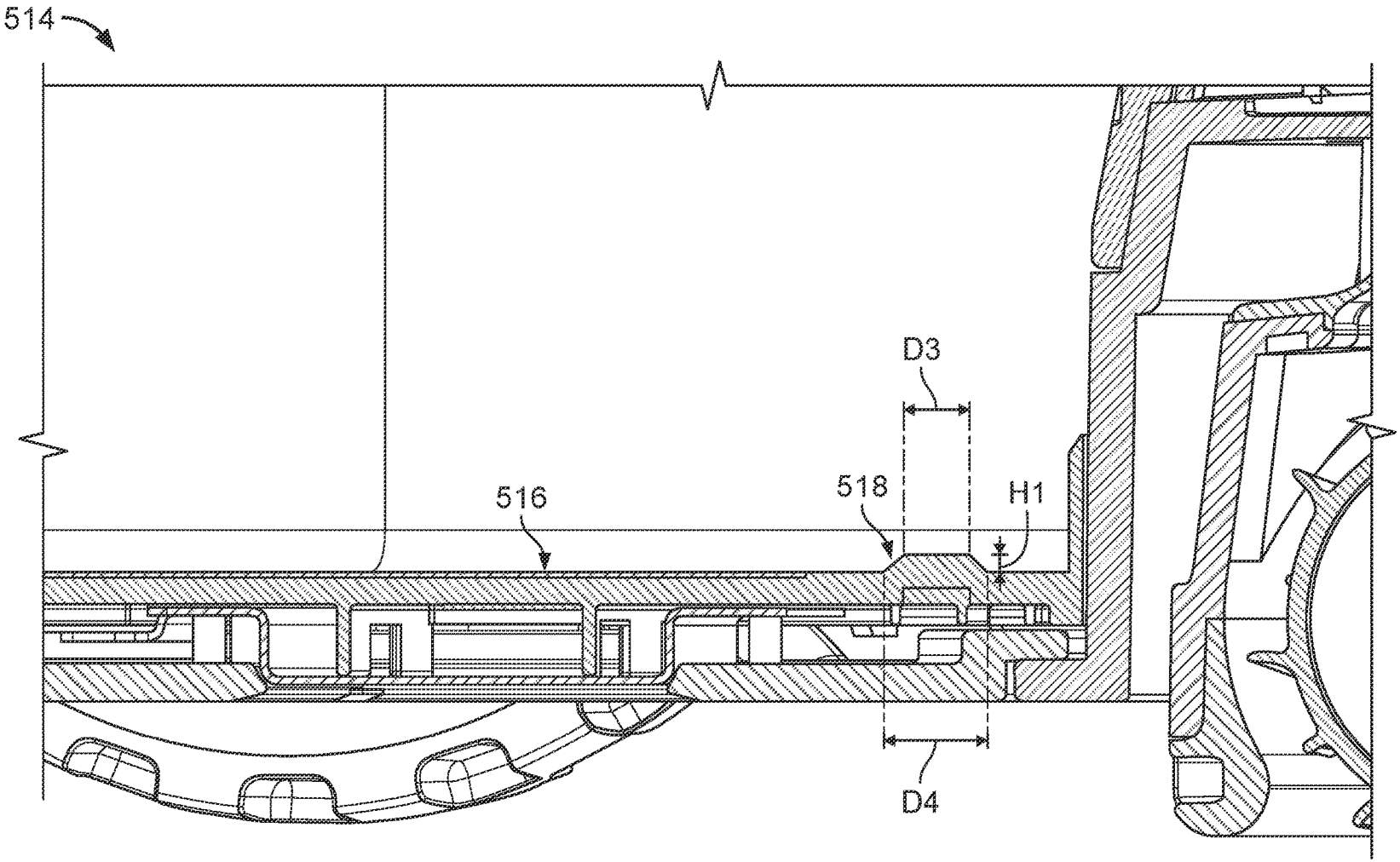
FIG. 5 is a cross sectional view of a bottom surface defining the cavity shown in FIG. 4.

Referring to FIG. 5, a pillar 518 protrudes a height H1 above a bottom surface 516 that defines a cavity 514 of an autonomous cleaning robot (e.g., autonomous cleaning robot 300). In some implementations, the height H1 may be between 1 mm and 4 mm. In FIG. 5, H1 is approximately 1 mm. A bottom surface of the cleaning bin 306 contacts a top surface of the surface features (e.g., pillar 518) when the cleaning bin 306 is positioned in the cavity 514. As such, a vertical space, or clearance, is formed between the bottom surface 516 defining the cavity 514 and the bottom surface of the cleaning bin 306. Debris that has fallen into the cavity 514 is able to rest on the bottom surface 516 within the vertical space without disturbing the vertical position of the cleaning bin 306 within the cavity 514.

In the present implementation, the pillar 518 has a flat top surface configure to contact a bottom surface of the cleaning bin 306 when the cleaning bin 306 is positioned in the cavity 514. The flat top surface of the pillar 518 has a diameter D3, which may be between approximately 3 mm and 5 mm. The pillar 518 has slanted sides, which slope downward and outward from the flat top surface to connect the pillar 518 at a base to the bottom surface 516 defining the cavity 514. The base of the pillar 518 has a diameter D4, which may be between approximately 5 mm and 7 mm. Pillars (e.g., pillar 518) are formed on the bottom surface 516 of the cavity 514 to protrude past any debris that might be present on the bottom surface 516 of the cavity 514. The pillars are shaped to allow debris to be easily wiped out of the cavity 514 around the pillars. Additionally, movement of the cleaning bin 306 (e.g., as the autonomous cleaning robot 300 moves across a floor surface) in the cavity 514 and the shape of the pillars allows debris to slide off of the top of the pillars.

Contact Assembly

Figure 6:
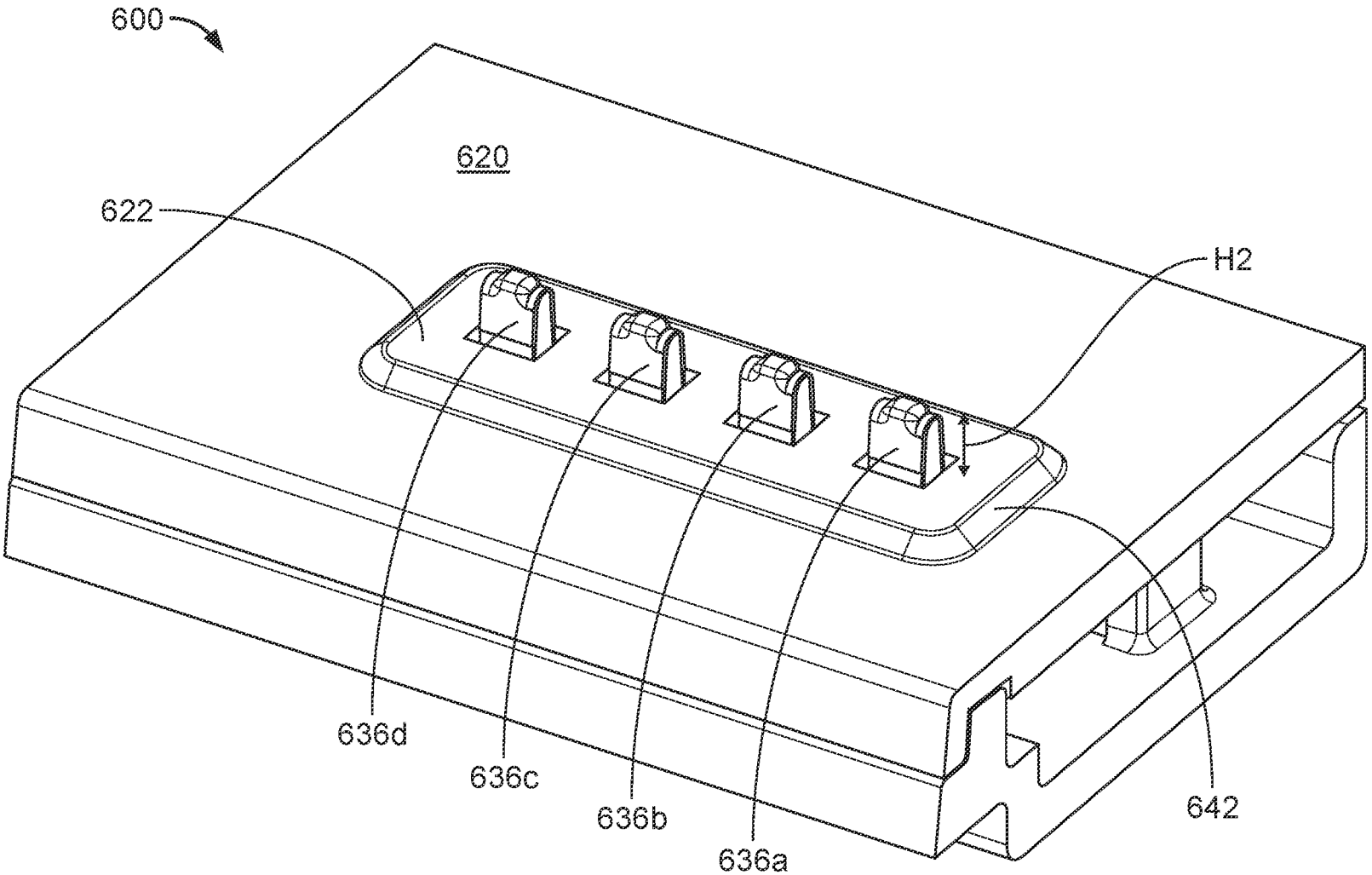
FIG. 6 is a perspective view of an electrical contact assembly of the autonomous cleaning robot of FIG. 1.

Referring to FIG. 6, a contact assembly 600 is configured to transfer power and control signals to the light ring 304 of the lid 302 of the autonomous cleaning robot 300. The contact assembly 600 includes four contacts, 636*a*, 636*b*, 636*c*, and 636*d*, which protrude through corresponding slots 736*a*, 736*b*, 736*c*, 736*d*, (more easily seen in FIG. 7) in a raised surface 622. The contacts 636*a-d* protrude through the raised surface 622 by a height H2, which may be approximately 1 mm to 3 mm. The raised surface 622 extends above a horizontal surface 620 of a body 308 of the autonomous cleaning robot 300. The raised surface 622 is surrounded by a sloping surface 642 to allow debris, etc., to slide off of the first horizontal surface 622. Debris may also fall into the slots 742*a-d* in the raised surface 622. Debris sitting on the raised surface 622 may interfere with an electrical connection between the contacts 636*a-d* and the contact pads 310 being formed or maintained.

The contacts 636*a-d* are configured to flex vertically (i.e., extend a variable distance from the raised surface 622) as the contacts 636*a-d* are contacted by the contact pads 310 on the lid 302 of the autonomous cleaning robot 300. The contacts 636*a-d* are configured to flex horizontally as the autonomous cleaning robot 300 moves about a floor surface during a cleaning mission. During the cleaning mission, the autonomous cleaning robot 300 can bump into objects, traverse flooring changes, etc., which may cause the lid 302 to move differently than the body 308 of the autonomous cleaning robot 300. For example, if the lid 302 is bounced slightly upward (i.e. the lid 302 moves upward relative to the body 308, but does not come unlatched from the body 308 of the autonomous cleaning robot 300) due to the autonomous cleaning robot 300 encountering an obstacle, the contacts 636*a-d* will flex vertically upward to maintain contact with the contact pads 310 on the lid 302. The vertical flexing of the contacts 636*a-d* therefore allows the electrical connection, and therefore the transmission of power and data, to be maintained As the contact pads 310 contact the contacts 636*a-d* when the lid is closed, the contacts 636*a-d* may flex horizontally as well as vertically. Due to a dome shape of a dimple 808 (see FIGS. 8A and 8B), the contact pads 310 are mechanically scrubbed during the horizontal and vertical flexing of the contacts (due to pressure applied upward onto the contact pads 310 from the contacts 636*a-d*). The scrubbing action aids in removing build up of dust and debris from the contact pads 310 and the contacts 636*a-d*. In some instances, excess build up on either the contact pads 310 or the contacts 636*a-d* may prevent an electrical connection from forming. The contact pads 310 have a rectangular shape and are sized to correspond to a width of the contacts 636*a-d*. In some implementations, the contact pads 310 are each approximately 3 mm by 3 mm in size.

Figure 7:
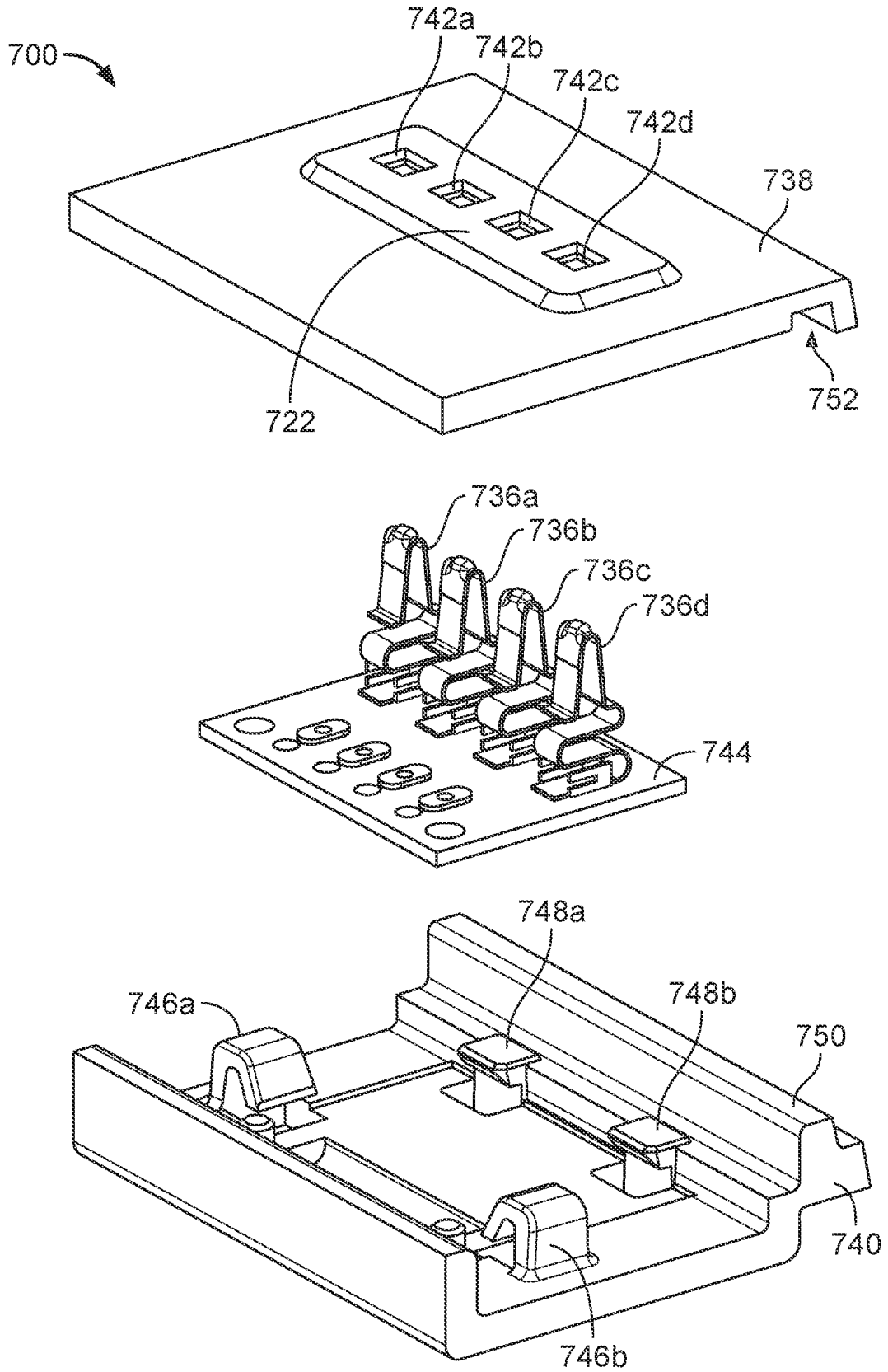
FIG. 7 is an exploded view of the electrical contact assembly of FIG. 6.

Referring to FIG. 7, an exploded view of a contact assembly 700 shows four contacts 736*a*, 736*b*, 736*c*, and 736*d*, positioned on a circuit board 744. In this instance, the contacts 736*a-d* are surface mounted to the circuit board. The circuit board 744 is fixed to a base 740 by fasteners 746*a*, 746*b*, 748*a*, and 748*b*. The base 740 has a lip 750 configured to fit in a corresponding groove 752 on an underside of a top portion 738 of the contact assembly 700. The top portion 738 and the base 740 may be portions of the body 308 of the autonomous cleaning robot 300. The lip 750 and the groove 752 are configured to allow the contacts 736*a-d* to protrude through the slots 742*a-d* in a raised surface 722. The contacts 736*a-d* are configured to connect to the circuit board 744 and pass data, via electrical signals, and power between the contact pads 310 on the lid 302 and the circuit board 744. In the present implementation, two of the four contacts 736*a-d* are configured to pass data between the contact pads 310 and the circuit board 744 and the other two of the four contacts 736*a-d* are configured to pass power between the contact pads 310 and the circuit board 744. In some implementations, the two contacts passing data are inside of the two contacts passing power. In other implementations, the two contacts passing data are outside of the two contacts passing power. The circuit board 744 is configured to connect to a power source (e.g., a battery) of the autonomous cleaning robot 300 and to a controller of the autonomous cleaning robot 300.

Based on a status of the autonomous cleaning robot 300, the controller may send a signal to the light ring 304 on the lid 302 to cause the light ring 304 to illuminate. A status of the autonomous cleaning robot 300 may be, for example, a status of the cleaning bin 306 (e.g., a fullness level), a status of another component of the autonomous cleaning robot 300 (e.g., a side brush 106 (shown in FIG. 1), a cleaning head (not shown), etc.), a status of a cleaning mission (e.g., mission complete, mission paused, mission error), etc. In some implementations, the controller may send a control signal corresponding to a particular illuminated configuration (e.g., pattern, color, timing of illumination) of the light ring 304 that corresponds to the status of the autonomous cleaning robot 300. The control signal from the controller is transmitted through the circuit board 744 and at least one of the electrical contacts 736*a-d* to the light ring 304 via a connection between the at least one of the electrical contacts 736*a-d* and at least one corresponding contact pad 310 on the lid 302. The shape of the electrical contacts 736*a-d* as well as the mounting configuration of the contact assembly 700 contributes to maintaining the electrical connection between the electrical contacts 736*a-d* and the contact pads 310.

Figure 8B:
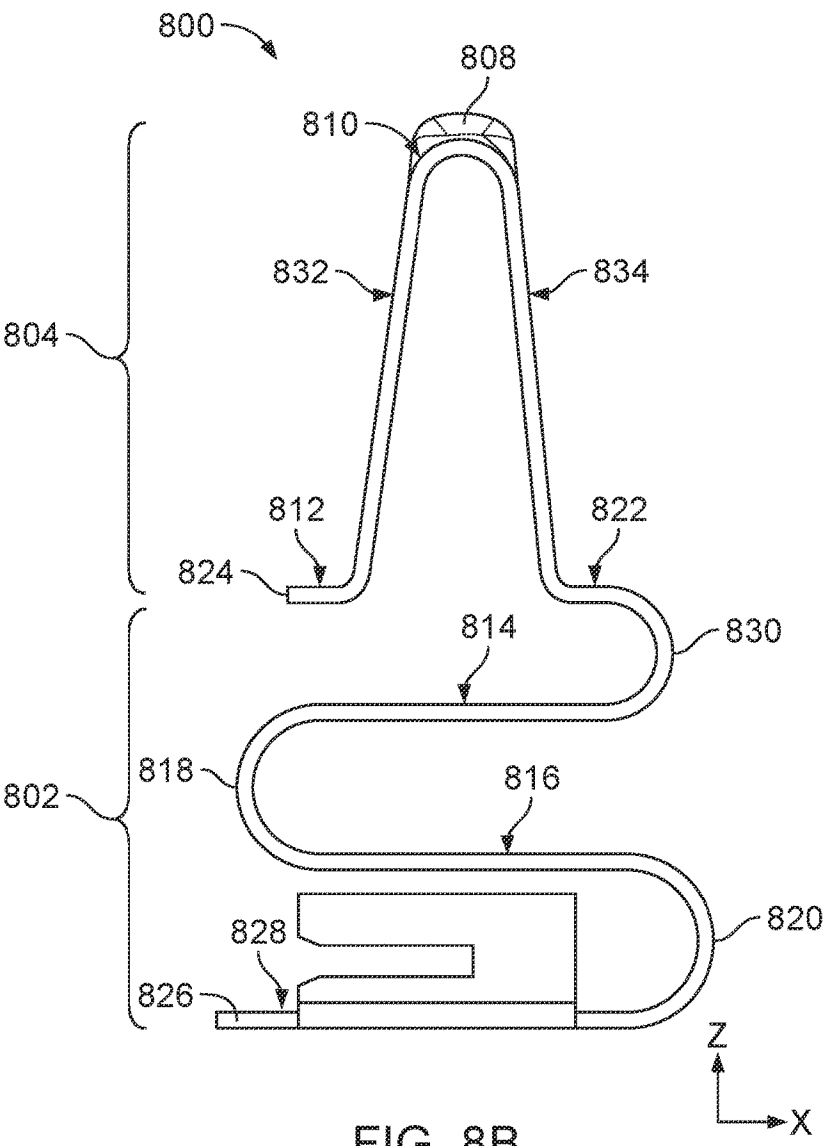
FIG. 8B is a side view of an electrical contact of the electrical contact assembly of FIG. 6.
Figure 8A:
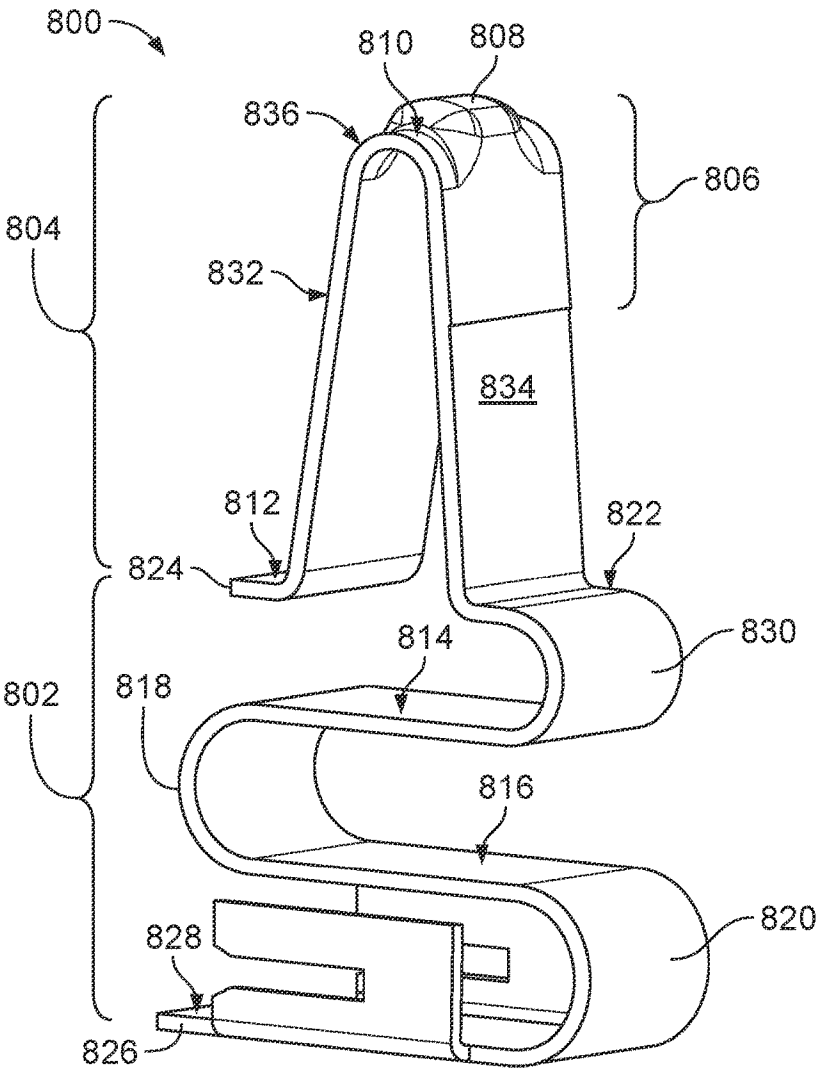
FIG. 8A is a perspective view of an electrical contact of the electrical contact assembly of FIG. 6.

Referring to FIGS. 8A and 8B, a contact 800 (e.g., one of contacts 736*a-d* shown in FIG. 7) includes a top portion 804 and a bottom portion 802. The top portion 804 of the contact 800 includes a tip 806. The tip 806 may be made from a different material than the remainder of the contact 800, i.e., a portion of the top portion 804 that does not include the tip 806 and the bottom portion 804. In some instances, the tip 806 may be made of a gold material. In some instances, the tip 806 is plated in gold. In some instances, the remainder of the contact 800 may be made of a copper alloy, a nickel material, another metal, etc. In some implementations, the tip 806 of the contact 800 and the remainder of the contact 800 are made of the same material. In some implementations, the contact is made of a first material (e.g., a copper alloy, nickel, etc.) and the tip 806 is plated or coated with a second material (e.g., gold).

The tip 806 of the contact 800 includes a dimple 808, which contacts a corresponding contact pad 310 on the lid 302 of the autonomous cleaning robot 300 when the lid 302 is closed. The dimple 808 has an approximately dome-shaped outer surface which allows the dimple 808 to make contact with (e.g. by scraping along) the contact pad of the lid 302 as the lid 302 pivots about hinge 430 during opening and closing. The dome-shaped outer surface provides an approximately circular contact region between the electrical contact 800 and the corresponding contact pad 310. The dimple 808 is raised by approximately 0.5 mm to avoid damage to the contact pads 310 from the sharper edges (e.g., edge 836) of the contacts. In some implementations, the dimple 808 may be raised between approximately 0 and 1 mm (e.g., 0 to 0.1 mm, 0 to 0.25 mm, 0 to 0.5 mm, 0 to 0.75 mm, 0.1 to 0.25 mm, 0.1 to 0.5 mm, 0.1 to 0.75 mm, 0.1 to 1 mm, 0.25 to 0.5 mm, 0.25 to 0.75 mm, 0.25 to 1 mm, 0.5 to 0.75 mm, 0.5 to 1 mm, 0.75 to 1 mm, etc.) above the curved portion 810.

The top portion 804 of the contact 800 has a first free end 824 that includes a first horizontal surface 812. The horizontal direction is shown as the X direction and the vertical direction is shown as the Z direction in FIG. 8B. The bottom portion has a second free end 826 that includes a second horizontal surface 828. Between the first free end 824 and the second free end 826, the contact 800 includes alternating curved portions 820, 818, 830, 810 and straight portions 816, 814, 822, 834, 832. The contact 800 may be formed as one piece. Two of the straight portions 832 and 834 are angled portions that extend upward from horizontal surfaces 812 and 822, respectively. The angled portions 832 and 834 are angled toward one another as the angled portions 832 and 834 approach curved portion 810 at the tip 806 of the contact 800. The contact 800 is horizontally flexible because the angled surfaces 832 and 834 are configured to move toward one another in a compressed position. The contact 800 is vertically flexible because the alternating curved portions 820, 818, 830 and straight portions 816, 814, which form a double curved, or S-shaped bottom portion 802 of the contact 800, forms a spring-like structure. The straight portions 816 and 814 can move toward one another during vertical compression. The contact 800 can travel vertically between approximately 1 and 2 mm between the compressed position and an extended position. When the lid 302 of the autonomous cleaning robot 300 is closed and the contacts 736*a-d* are in the compressed position, the contacts 736*a-d* can provide at least 75 grams of force on the lid 302. The raised surface 622 provides horizontal control (in both the X direction and a Y direction, which is orthogonal to the X and Z directions shown in FIG. 8B). A clearance of approximately 0.25 mm in all directions between the electrical contact 800 and raised surface 622 allows for free vertical motion, and ensures space for dust to drop through when the contact 800 is compressed.

Figure 9:
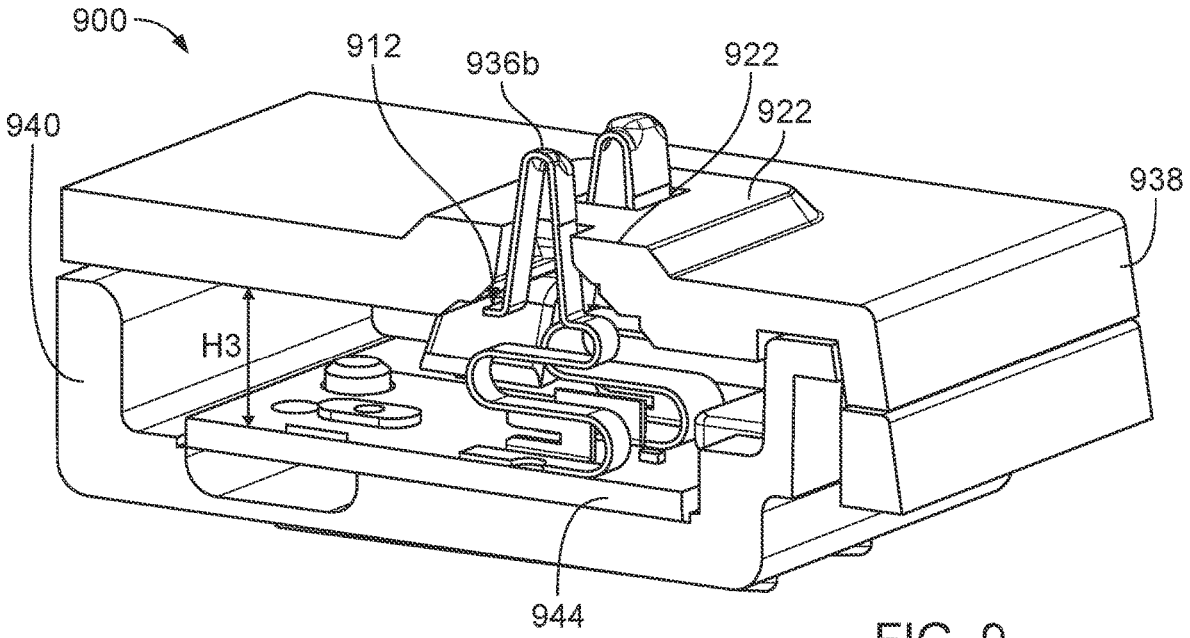
FIG. 9 is a cross sectional view of the electrical contact assembly of FIG. 6.

Referring to FIG. 9, a cross sectional view of a contact assembly 900 bisects contact 936*b* as contact 936*b* protrudes through a raised surface 922. A circuit board 944 is secured to a base 940. When the contact assembly 900 is assembled, a top surface of the circuit board 944 and an underside of a top portion 938 of the contact assembly 900 are positioned a height H3 apart. Height H3 is between approximately 3.5 mm and 4.5 mm. The top portion 938 and the base 940 may be portions of the body 308 of the autonomous cleaning robot 300. The contact 936*b* may contact an underside of the top portion 938 of the contact assembly 900 with two horizontal surfaces 912 and 922 when the contact 936*b* is in the extended position. As the contact 936*b* is compressed, the horizontal surfaces 912 and 922 may lift off of the underside of the top portion 938 and move toward the circuit board 944. As mentioned previously, the vertical travel of the contact between the compressed position and the extended position is between approximately 1 and 2 mm.

Airflow Channel Clearing Method

Figure 10:
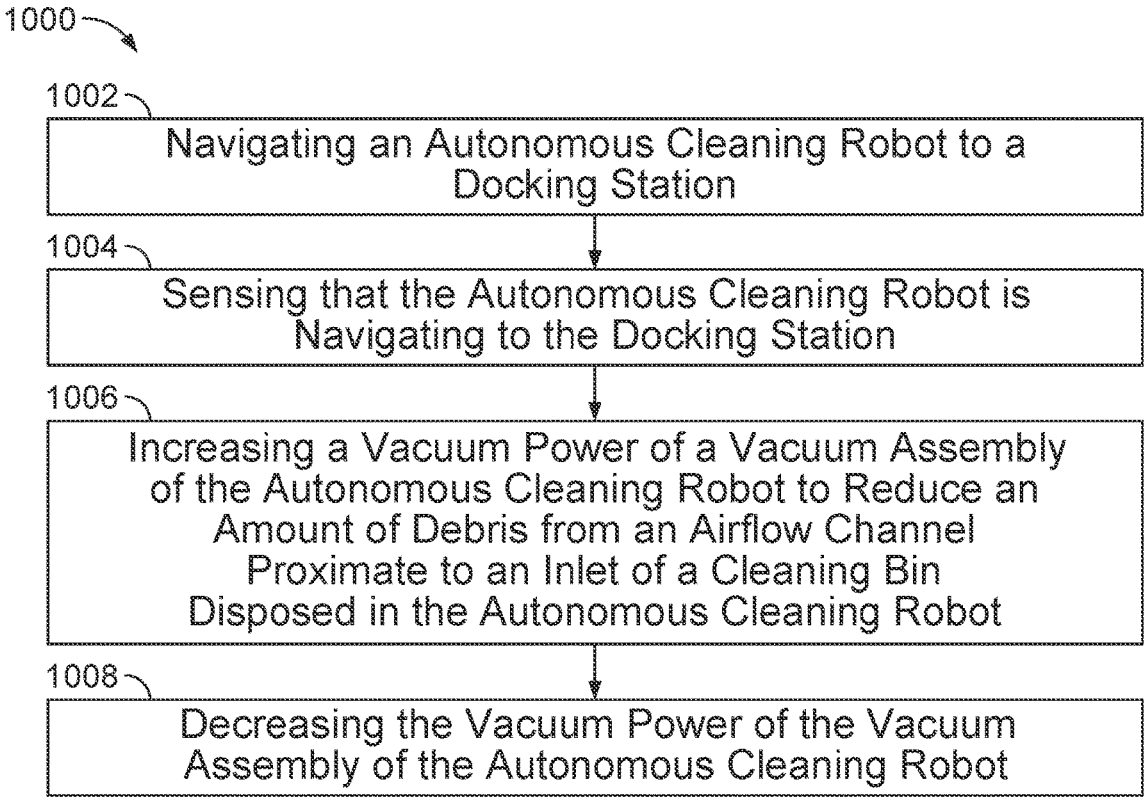
FIG. 10 is a flow chart describing a method for operating the autonomous cleaning robot FIG. 1.

Referring to FIG. 10, to prevent debris from falling into the cavity 414 from shelf 426, the autonomous cleaning robot 300 may be operated to pull debris deposited on the shelf 426 into the cleaning bin 306. A method 1000 of operating the autonomous cleaning robot 300 includes navigating (1002) the autonomous cleaning robot 300 to a docking station. The method also includes sensing (1004) that the autonomous cleaning robot 300 is navigating to the docking station. Sensing may include, for example, receiving a signal, e.g., from a bump sensor, a camera, a gyroscope, etc., at the controller of the autonomous cleaning robot 300. Sensing may include, for example, computing, at the controller, a location of the autonomous cleaning robot 300 based on a navigation system or a mapping system. The method also includes increasing (1006) a vacuum power of a vacuum assembly (not shown) of the autonomous cleaning robot to reduce an amount of debris from an airflow channel (e.g., deposited on shelf 426) proximate to an inlet of the cleaning bin 306 disposed in the autonomous cleaning robot 300. In some implementations, the increased vacuum power corresponds to a motor speed between 20,000 rpm and 24,000 rpm (e.g., 22,000 rpm, etc.). In some implementations, increasing the vacuum power occurs during a time interval of about 5 to 15 seconds (e.g., 10 seconds).

The method also includes, subsequent to increasing the vacuum power, decreasing (1008) the vacuum power of the vacuum assembly of the autonomous cleaning robot 300. In some instances, decreasing the power occurs after the autonomous cleaning robot 300 contacts the docking station. In some instances, decreasing the power occurs before the autonomous cleaning robot 300 contacts the docking station. Decreasing the power of the vacuum assembly may include returning the vacuum assembly to a power level at which the vacuum assembly was operating before increasing the power to clear the debris. Decreasing the power of the vacuum assembly may include turning the vacuum power to zero, thereby shutting off the vacuum assembly.

A number of implementations have been described. Nevertheless, it will be understood that various modifications may be made. Accordingly, other implementations are within the scope of the claims.

What is claimed is:

1. A method of controlling an autonomous cleaning robot, the method comprising:

navigating the autonomous cleaning robot to a docking station;

sensing that the autonomous cleaning robot is navigating to the docking station;

increasing a vacuum power of a vacuum assembly of the autonomous cleaning robot to reduce an amount of debris from an airflow channel proximate to an inlet of a cleaning bin disposed in the autonomous cleaning robot; and then decreasing the vacuum power of the vacuum assembly of the autonomous cleaning robot.

2. The method of claim 1, wherein the autonomous cleaning robot moves to the docking station as the autonomous cleaning increases the vacuum power.

3. The method of claim 1, wherein decreasing the vacuum power of the vacuum assembly occurs when the robot is docked at the docking station.

4. The method of claim 1, wherein decreasing the vacuum power of the vacuum assembly occurs before docking at the docking station is completed.

5. The method of claim 1, wherein the increased vacuum power corresponds to a motor speed between 20,000 rpm and 24,000 rpm.

6. The method of claim 1, wherein the increased vacuum power is corresponds to a motor speed of approximately 22,000 rpm.

7. The method of claim 1, wherein increasing the vacuum power occurs during a time interval between approximately 5 seconds and 15 seconds.

8. The method of claim 6, wherein the time interval is approximately 10 seconds.

9. The method of claim 1, wherein decreasing the vacuum power is initiated before the autonomous cleaning robot contacts the docking station.

10. The method of claim 1, wherein decreasing the vacuum power is initiated after the autonomous cleaning robot contacts the docking station.

11. A method of controlling a mobile cleaning robot including a vacuum assembly and a cleaning bin, the method comprising:

determining that the mobile cleaning robot is navigating to a docking station;

then increasing a vacuum power of the vacuum assembly to increase flow through an airflow channel located near an inlet of the cleaning bin; and then decreasing the vacuum power of the vacuum assembly of the mobile cleaning robot.

12. The method of claim 11, further comprising:

determining a location of the mobile cleaning robot;

wherein determining that the mobile cleaning robot is navigating to a docking station is based on the determined location of the mobile cleaning robot.

13. The method of claim 12, wherein determining the location of the mobile cleaning robot is performed using a mapping system.

14. The method of claim 13, further comprising:

determining that the mobile cleaning robot has contacted the docking station; and then decreasing the vacuum power after the mobile cleaning robot contacts the docking station after the vacuum power has been increased in response to determining that the robot is navigating to the docking station.

15. The method of claim 14, wherein determining the mobile cleaning robot has contacted the docking station is performed using at least one of the mapping system or a signal from a camera of the mobile cleaning robot.

16. The method of claim 13, further comprising:

extracting debris from a shelf of the airflow channel into the cleaning bin when the vacuum power is increased in response to determining that the robot is navigating to the docking station.

17. A method of controlling a mobile cleaning robot including a vacuum assembly and a cleaning bin, the method comprising:

determining that the mobile cleaning robot is navigating to a docking station;

in response, increasing a vacuum power of the vacuum assembly through an airflow channel located near an inlet of the cleaning bin; and then extracting debris from a shelf of the airflow channel into the cleaning bin when the vacuum power is increased.

18. The method of claim 17, further comprising:

determining a location of the mobile cleaning robot using a mapping system;

wherein determining that the mobile cleaning robot is navigating to a docking station is based on the determined location of the mobile cleaning robot.

19. The method of claim 17, further comprising, after the increasing the vacuum power of the vacuum assembly through the airflow channel located near the inlet of the cleaning bin:

determining that the mobile cleaning robot has contacted the docking station using the mapping system; and decreasing the vacuum power in response to determining that the mobile cleaning robot has contacted the docking station.

20. The method of claim 19, wherein the increased vacuum power corresponds to a motor speed between 20,000 rpm and 24,000 rpm, and wherein increasing the vacuum power occurs during a time interval between approximately 5 seconds and 15 seconds.

* * * * *